US007934723B2

(12) United States Patent
Sasaki et al.

(10) Patent No.: US 7,934,723 B2
(45) Date of Patent: May 3, 2011

(54) PUSHER GAME MACHINE

(75) Inventors: Ryu Sasaki, Tokyo (JP); Atsushi Inoue, Tokyo (JP); Motoki Imanishi, Tokyo (JP); Etsushi Torii, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 457 days.

(21) Appl. No.: 11/997,463

(22) PCT Filed: Aug. 1, 2006

(86) PCT No.: PCT/JP2006/315219

§ 371 (c)(1),
(2), (4) Date: Jan. 31, 2008

(87) PCT Pub. No.: WO2007/015487

PCT Pub. Date: Feb. 8, 2007

(65) Prior Publication Data

US 2010/0096803 A1 Apr. 22, 2010

(30) Foreign Application Priority Data

Aug. 2, 2005 (JP) ..... 2005-224534
Aug. 2, 2005 (JP) ..... 2005-224538
Aug. 2, 2005 (JP) ..... 2005-224544

(51) Int. Cl.
*A63F 7/02* (2006.01)

(52) U.S. Cl. ..... 273/138.3; 273/138.2; 273/454; 273/460; 273/459

(58) Field of Classification Search ..... 273/138.2, 273/138.1, 138.3, 274, 440, 454, 460, 459; 463/7

See application file for complete search history.

(56) References Cited

U.S. PATENT DOCUMENTS

| | | | | |
|---|---|---|---|---|
| 4,496,160 | A | 1/1985 | Wichinsky et al. | 273/369 |
| 5,622,366 | A | 4/1997 | Inoue | 273/138.2 |
| 5,887,870 | A | 3/1999 | Kumabe et al. | |
| 2003/0020234 | A1 | 1/2003 | Jordan | 273/138.3 |

FOREIGN PATENT DOCUMENTS

| | | | |
|---|---|---|---|
| DE | 20117936 | U1 | 2/2002 |
| GB | 2293774 | A | 4/1996 |
| JP | 59-95078 | A | 5/1984 |
| JP | 4-27983 | U | 3/1992 |
| JP | 06-190142 | A | 7/1994 |
| JP | 10-263199 | A | 10/1998 |

(Continued)

OTHER PUBLICATIONS

Extended European Search Report dated Nov. 9, 2010, corresponding to EP 06 78 2097.

*Primary Examiner* — Benjamin H Layno
(74) *Attorney, Agent, or Firm* — Edwards Angell Palmer & Dodge LLP; Peter C. Schechter; Catherine J. Toppin

(57) ABSTRACT

A pusher game machine 1 includes: a medal feeder 9 which feeds a medal on an upper game board 20; and an upper pushing member 22 which is arranged on the upper game board 20, and performs reciprocating movement, wherein a medal feedable region 61 by the medal feeder 9 is set on the deep side of the upper pushing member, viewing from the medal feeding side by the medal feeding means.

10 Claims, 10 Drawing Sheets

FOREIGN PATENT DOCUMENTS

| | | | |
|---|---|---|---|
| JP | 2001-038037 | A | 2/2001 |
| JP | 2001-232050 | A | 8/2001 |
| JP | 2002-177629 | A | 6/2002 |
| JP | 2002177629 | A | 6/2002 |
| JP | 2002-253842 | A | 9/2002 |
| JP | 2003-079933 | A | 3/2003 |
| JP | 2003-181127 | A | 7/2003 |
| JP | 2004-073751 | A | 3/2004 |
| JP | 2004-187963 | A | 7/2004 |
| JP | 2004-298400 | A | 10/2004 |
| TW | 562686 | * | 11/2003 |
| WO | 03/024549 | A1 | 3/2003 |

* cited by examiner

PUSHER GAME MACHINE

CROSS-REFERENCE TO PRIOR APPLICATION

This is a U.S. National Phase Application under 35 U.S.C. §371 of International Patent Application No. PCT/JP2006/315219 filed Aug. 1, 2006, which claims the benefit of Japanese Patent Application No. 2005-224534 filed Aug. 2, 2005; Japanese Patent Application No. 2005-224538 filed Aug. 2, 2005; and Japanese Patent Application No. 2005-224544 filed Aug. 2, 2005, all of which are incorporated by reference herein. The International Application was published in Japanese on Feb. 8, 2007 as WO 2007/015487 A1 under PCT Article 21(2).

TECHNICAL FIELD

The present invention relates to a pusher game machine which is used for playing games by feeding medals onto a game board.

BACKGROUND ART

A pusher game machine has been known so far (refer to, for example, Japanese Laid-Open Patent Application No. 2002-253842, Japanese Laid-Open Patent Application No. 2003-181127, and Japanese Laid-Open Patent Application No. 2004-187963), to have a pushing member that reciprocally moves on the game board. Medals that are fed on the game board through a medal feeder such as a medal chute are pushed out by a pushing member, which causes pileup operation among medals accumulated on the game board, and medals fall from the edge portion on the game board.

In a conventional pusher game machine, a moving direction of a medal fed by a medal feeder and a pushing-out direction of a medal on a game board by a pushing member face each other. A pushing-out surface on which the pushing member pushes a medal out is located on the deep side, and the edge portion on the game board, on which a medal falls by the pileup operation, is positioned on the front side, viewing from a player operating a medal feeder, respectively. Thereby, a feeding cite of a medal, and a position at which it is determined whether the medal falls as a result of the feeding are remote from each other, and it is impossible for a player to see whether the medal falls while he/she keeps looking the feeding cite of the medal. A player is therefore required to reciprocally look the deep side, and the front side in order to see the falling of a medal, and there is a possibility that the player can not devote herself or himself to playing games.

SUMMARY OF THE INVENTION

An object of the present invention is to provide a new-type pusher game machine in which a player can see medals falling from a game board by natural eye movement, and the player can devote herself or himself to playing games.

The pusher game machine according to the present invention has solved the above-described problems by a pusher game machine including: a medal feeding means which feeds a medal on a game board; and a pushing member which is arranged on the game board, and performs reciprocating movement, wherein a medal feedable region by the medal feeding means is set on the deep side of the pushing member, viewing from the medal feeding side by the medal feeding means.

According to the pusher game machine described above, the medal feeding direction and the medal pushing-out direction by the pushing member becomes the same as each other. Thereby, a player can see whether the medal falls on the game board by natural eye movement from the medal moving destination after feeding the medal toward the pushing-out direction by the pushing member. As unnatural eye movement is not required, that is, a player is not required to reciprocally look the deep side, and the front side in the medal moving direction, the player can devote herself or himself to playing games. Here, in the pusher game machine according to the present invention, a region in which a medal can be fed is not limited only to the deep side of the pushing member in the medal moving direction. A part of a medal feedable region in which a medal can be fed may be located on the deep side of the pushing member, and a part of the remainder of the medal feedable region may be positioned in the front side of the pushing member.

Moreover, the pusher game machine according to an aspect of the present invention, may further comprise a target opposing to a part of a deep edge portion, and a medal checker which can detect a medal falling from the game board and hitting the target on the deeper side of the deep edge portion, wherein the deep edge portion is located on the deep side of the game board, viewing from the feeding side. According to the present aspect, detection of a medal by the medal checker serves as the impetus for various kinds of events to increase enjoyment of the game. Furthermore, as the medal checker is provided at the feeding cite, a new game to make a player aim at a target may be offered, besides the ordinary games in which a medal falls from the deep edge portion of the game board by the pileup operation of medals by the pushing member. In this case, the target may be a medal passing hole which takes in a medal, the medal checker may be a sensor which can detect a medal which passes the medal passing hole. According to the above configuration, a player can clearly recognize that a medal is hit at a target, because the medal which is hit at a target passes through the medal passing hole.

However, when a player can easily aim at a medal checker, the player rather loses interest. Moreover, there is a possibility that a put-out rate is unreasonably increased when there is a configuration in which a large number of medals are put out in an event started by detection of a medal by the medal checker. Accordingly, in one aspect of a pusher game machine according to the present invention, a moving block member may be provided on the deeper side of the pushing member, wherein the moving block member blocks moving of a medal toward the deep side, viewing from the feeding side. According to the above aspect, movement of a number of medals toward the deep side is blocked by the moving block member, wherein the number of medals are fed on the surface of the game board. Thereby, it becomes difficult to feed medals, aiming directly at the medal checker, and the problem may be solved. But, in the present aspect, a fed medal can be prevented from easily falling from the game board regardless of the presence or absence of a pushing member even when provision of a medal checker is not assumed. Accordingly, the put-out rate of medals and the like can be appropriately controlled.

The block member may be provided so that the position thereof is not changed relative to the game board, or may be provided so that it can move with the pushing member integrally. When the moving block member is provided so as to move with the pushing member integrally, a disadvantage that a medal is caught between the moving block member and the pushing member may be prevented, because the distance between the medal block member and the pushing member is kept constant.

Moreover, the moving block member may be configured in such a way that the block member can be switched at a block position at which movement of a medal toward the deep side, viewing from the feeding side, is blocked, or at a release position at which the moving blocking is released. According to the present aspect, for example, when a position of the moving block member is usually set at a block position, and predetermined conditions are satisfied, a game, in which a medal checker is directly aimed at, may be played by changing the position to the release position, and very exciting gaming properties may be provided, though the game is limited at the block position.

Moreover, the pusher game machine according to one aspect of the present invention may include: a lower game board provided at a lower height position in the vertical direction than that of the game board; a lower pushing member provided on the lower game board in such a way that the lower pushing member can be reciprocatingly moved; and a pusher drive mechanism driving the pushing member and the lower pushing member in such a way that medals accumulated on the game board and on the lower game board are pushed out, wherein a direction in which a medal is pushed out by the pushing member, and a direction in which a medal is pushed out by the lower pushing member are set to be different from each other. According to the present aspect, it can be prevented that the size of the device is increased in one direction in which medals are pushed out, because the medal pushing-out direction on the game board and the medal pushing-out direction on the lower game board are different from each other. Thereby, even when the number of game boards is increased, a reasonable layout can be realized to improve the space efficiency. As a position at which a medal falls from the game board, and a position at which a medal falls from the lower game board are set to be located on different sides from each other, a fresh medal falling process can be given to a player, and the enjoyment of the pusher game machine is improved.

In the present aspect, a direction at which a medal is pushed out by the pushing member, and a direction at which a medal is pushed out by the lower pushing member may be set to be parallel with each other. In this case, the pushing out direction of a medal on the game board, and the pushing out direction of a medal on the lower game board are opposite to each other. That is, a medal falls from the deep side of the game board, and a medal falls from the front side of the lower game board. Thereby, flows of medals accumulated on each of the game boards are returned. As a position at which a medal falls from the game board, and a position at which a medal falls from the lower game board go away from each other, medal falling processes become more dynamic.

Moreover, the pusher drive mechanism may include: a driving source; a power transmission means which transmits the power of the driving source to either of the pushing member and the lower pushing member; and a connection means connecting the above pushing member and the other pushing member. In this case, power is transmitted to other pushing member through connection means by transmitting power from one driving source to one pushing member through the power transmission means. Thereby, a driving source is not required to be provided one by one for each of the pushing members, and the configuration is simplified.

As the medal feeding direction and the medal pushing-out direction by the pushing member become the same as each other as described above, according to the present invention, a player can see falling of a medal by natural eye movement in which movement of a medal is followed after the medal is fed. Thereby, as a player is not required to reciprocally look the deep side, and the front side in the medal moving direction, the player may devote herself or himself to playing games.

DETAILED DESCRIPTION OF THE INVENTION

Figure 1:
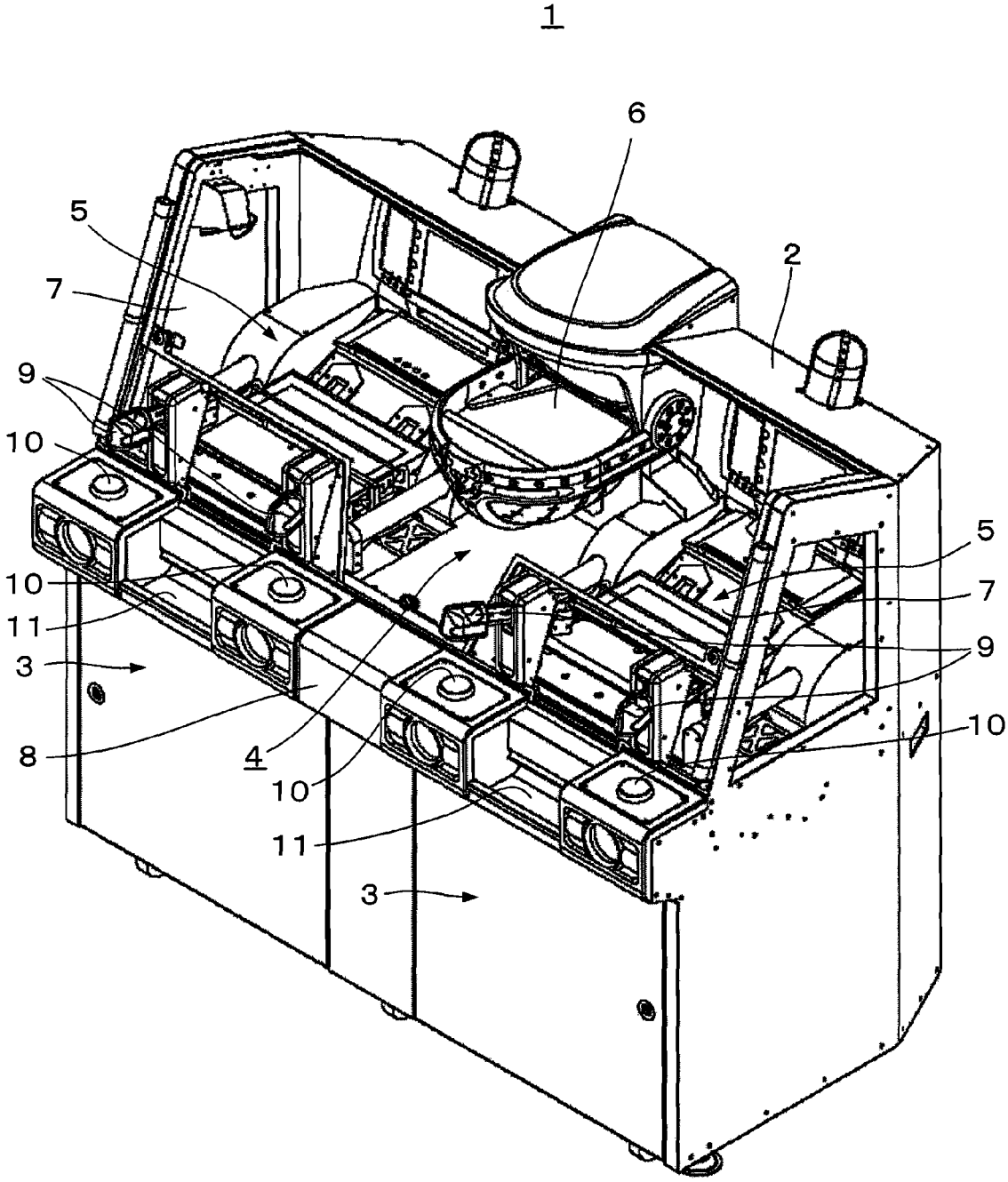
FIG. 1 is a perspective view showing one form of a pusher game machine according to the present invention.

FIG. 1 is a perspective view showing one form of a pusher game machine to which the present invention is applied. A pusher game machine 1 is provided as a commercial game machine (so called an arcade game machine) which is installed on the floor in a commercial facility such as a game shop, and provides games within a predetermined range as compensation for consumption of economical value by a player. The pusher game machine 1 is a kind of a medal game machine, and an economical value is consumed by feeding medals by a player.

In the pusher game machine 1, two right and left stations 3 are integrated into a single chassis 2. A station is a minimum unit of field where a player plays a game. A game space 4 is provided in the upper portion of the chassis 2, and a game execution portion 5 is provided on the side of the bottom surface of the game space 4 for each station. Details of the game execution portion 5 will be described later. A medal put-out device 6 that is shared among the stations 3 is arranged between the game execution portions 5. The game space 4 is covered with a transparent cover 7 in order to prevent an access to the game execution portion by a player. A control panel 8 is provided on the front side of the chassis 2, and a pair of right and left medal feeders 9 are provided above the control panel 8 for each station 3. A medal rolls through the medal feeder 9 while it vertically stands to be fed into the game execution portion 5. The end of the medal feeder 9 is inserted into the game space 4, piercing through the cover 7. In order to make the medal feeding position be changed by operation of a player, the medal feeder 9 is configured so that the direction thereof may be adjusted within a predetermined limit in each of the vertical and horizontal directions. A well-known medal chute commonly used for so-called pusher game machine may be used for the medal feeder 9.

Push-button type operation switches 10 are provided on the control panel 8, wherein the operation switches 10 are arranged corresponding to each of the medal feeders 9 one by one. Though detailed description will be omitted, an operation switch 10 outputs a signal corresponding to operation of a player. This signal is used for various pieces of game processing. Moreover, a medal receiver 11 is provided in the control panel 8 for each station 3. The medal receiver 11 is formed by sheet processing of a metallic material such as stainless steel plate, and is provided as a medal put-out destination which the player has acquired.

Figure 2:
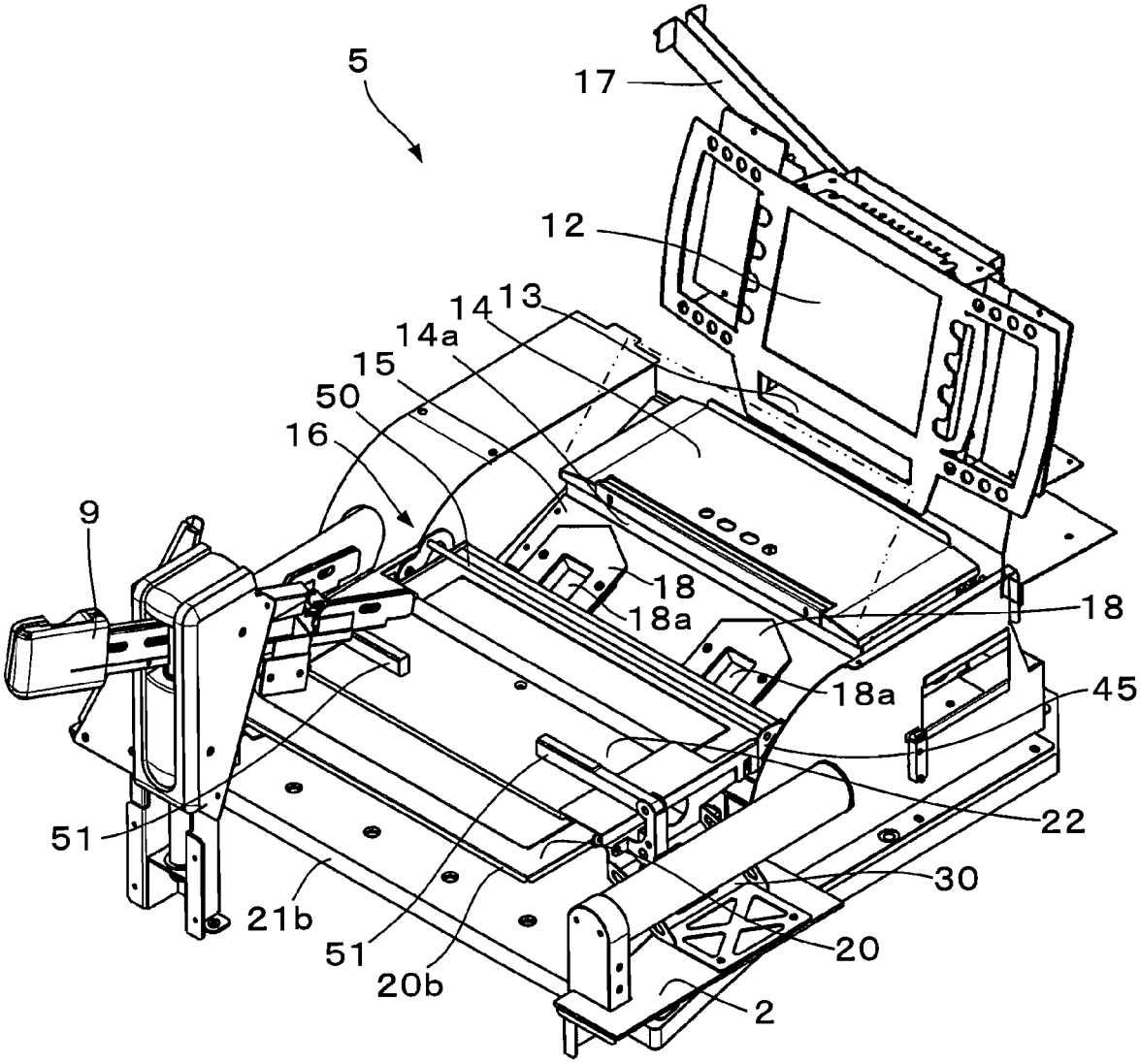
FIG. 2 is a perspective view showing details of a game execution portion from an upper stage to a game board portion.
Figure 3:
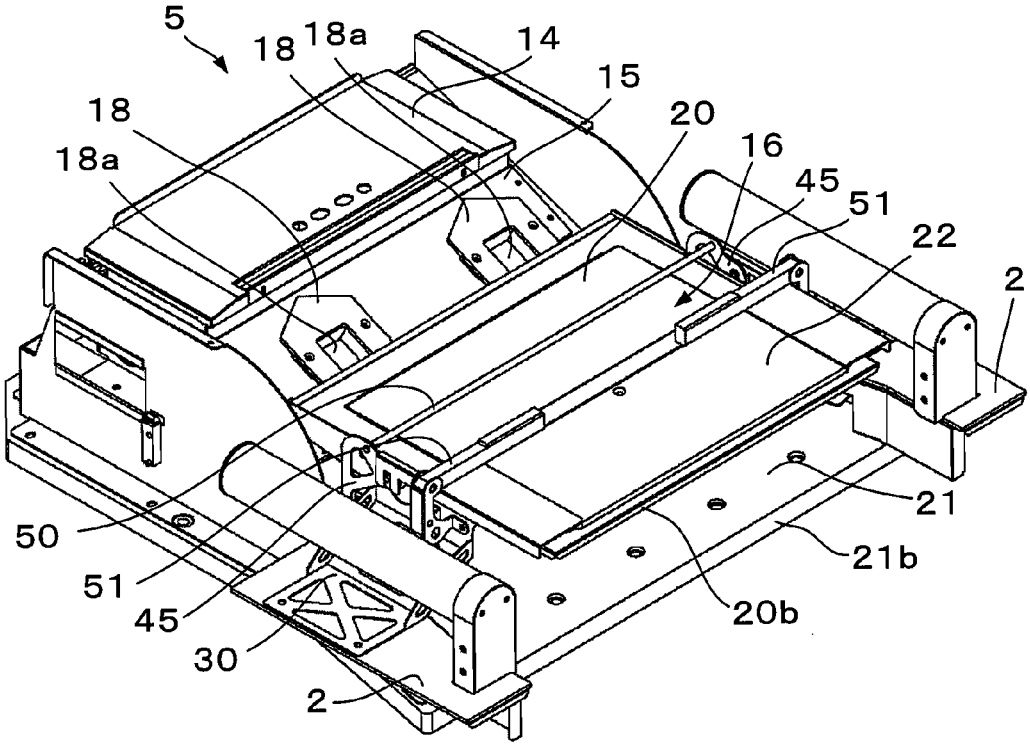
FIG. 3 is a perspective view showing a state in which a pushing member is in a retracted position.

Subsequently, details of the game execution portion 5 will be explained, referring to FIG. 2 through FIG. 6. Here, as the configurations of the game execution portions 5 provided for each station 3 are the same as each other, one game execution portion 5 will be explained in the following description. As shown in FIG. 2, the game execution portion 5 includes from the deep side toward the front side, viewing from the medal feeding side at the medal feeder 9: a monitor 12; a medal put-out port 13; an upper stage 14; an inclination stage 15; and a game board portion 16. The monitor 12 is provided as a display means for game execution and various kinds of game representation in each of stations 3. The medal put-out port 13 is arranged just under the monitor 12. A medal sent out from a medal hopper device in the chassis 2 (not shown) to a medal guide 17 is put out from the medal put-out port 13 toward the upper stage 14. The upper stage 14 is movably provided between a horizontal position shown in solid lines in the drawing, and an operation position lifted upward with a front end edge 14*a* as a fulcrum as shown with imaginary lines in the drawing. A couple of medal checkers 18 and 18 are provided above the inclination stage 15, and a medal passing hole 18*a* with a rectangular shape is formed on each of the medal checkers 18, wherein the medal passing hole 18*a* is set to horizontally be extended, and to be set slightly larger than the diameter of the medal (refer to FIG. 5). When the medal passes through the medal passing hole 18*a* in a state in which the medal is directed sideways, the medal checker 18 detects the passing, and outputs a medal detection signal. Though detailed description is omitted, various kinds of game processing is started when the medal detection signal is output, and, as a result of the processing, predetermined number of medals are put out from the medal put-out port 13.

FIG. 3 through FIG. 6 show details of the game execution portion 5 from the upper stage 14 to the game board portion 16. As it is clear from the drawings, the game board portion 16 includes an upper game board 20 and a lower game board 21 wherein the board 20 and the board 21 are different from each other in the height in the vertical direction. The upper game board 20 and the lower game board 21 are arranged in such a way that the board 20 and the board 21 are approximately parallel with each other with a predetermined distance (refer to FIG. 6). The upper game board 20 is fixed to the chassis 2 through a pair of right and left brackets 30 and 30. The upper game board 20 has an area large enough to conceal the lower end portion of the inclination stage 15 and the lower game board 21 (refer to FIG. 5).

Figure 6:
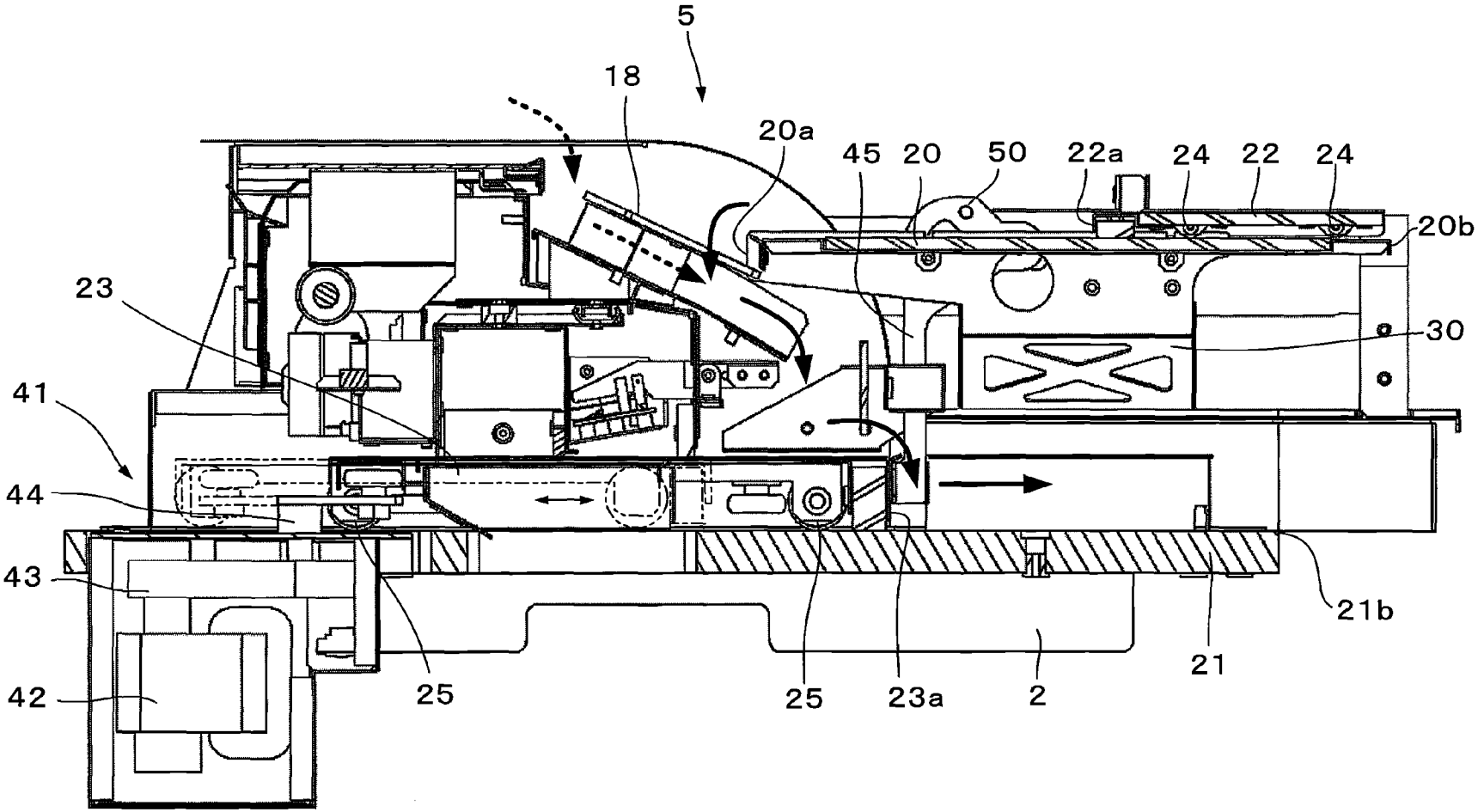
FIG. 6 is a longitudinal cross-sectional view of the game execution portion along the vertical direction at the center portion in FIG. 5.

As shown in FIG. 6, there are led onto the lower game board 21 a medal which falls from the upper stage 14, passing through a route indicated by an arrow of dashed line through the inclination stage 15, and a medal which falls from the upper game board 20, passing through a route indicated by an arrow of a solid line through the inclination stage 15, respectively. Moreover, on the deep side of the lower game board 21 (the left side in FIG. 6), a lower pushing member 23 is supported on the lower game board 21 through rollers 25 arranged in the front and rear portions. Thereby, the lower pushing member 23 is provided in such a way that the member 23 can be reciprocatingly moved between a pushing out position shown by solid lines, and a retracted position shown by imaginary lines. The lower pushing member 23 has a pushing-out surface 23*a*, and is driven by a pusher driving mechanism 41 in such a way that medals accumulated on the front side (the right side in FIG. 6) of the pushing-out surface 23*a* are pushed out to the pushing out position. The pusher driving mechanism 41 includes: a driving motor 42; a deceleration mechanism 43 decelerating rotation of the driving motor 42; and a slider crank mechanism 44 which transmits rotational movement output from the deceleration mechanism 43 to the lower pushing member 23 by converting the rotational movement into straight line movement. Not only the mechanism shown in FIG. 6, but also a mechanism used for well-known pusher game machines may be applied for the pusher driving mechanism 41.

On the other hand, the upper pushing member 22 is supported on the upper game board 20 through rollers 24 arranged in the front and rear portions (refer to FIG. 6). The upper pushing member 22 also has a pushing-out surface 22*a*, and the member 22 can be reciprocatingly moved between a retracted position shown in FIG. 3 and FIG. 5, and a pushing out position shown in FIG. 2, FIG. 4, and FIG. 6. The upper pushing member 22 is connected to the lower pushing member 23 through a pair of right and left link arms 45 and 45 which are vertically extending. Thereby, the upper pushing member 22 is driven by the pusher driving mechanism 41 through the link arms 45 in synchronization with the lower pushing member 23 in such a way that medals accumulated on the deep side of the pushing-out surface 22*a* on the upper pushing member 22 are pushed out to the pushing out position. That is, when the lower pushing member 23 is moved from the retracted position to the pushed-out position, the upper pushing member 22 is moved from the pushed-out position to the retracted position, and, when the lower pushing member 23 is moved from the pushed-out position to the retracted position, the upper pushing member 22 is moved from the retracted position to the pushed-out position. Here, the reciprocating movement of the upper and the lower two pushing members 22 and 23 may be configured not to be in synchronization with each other, and the member 22 and the member 23 may be configured to separately be driven from each other. In that case, a not-shown driving mechanism may be provided which can separately drive the upper pushing member 22. Any mechanism by which the upper pushing member 22 can perform reciprocating movement on the upper game board 20 is acceptable for the driving mechanism. The mechanism may be realized by, for example, a mechanism in which rotational movement of a driving motor in the slider crank mechanism and the like is converted into straight line movement and is transmitted to the upper pushing member 22 and another mechanism in which a linear motor is arranged on the right and left sides of the upper pushing member 22. By the configurations as described above, the upper and the lower two pushing members 22 and 23 are separately driven from each other to change the enjoyment of a game.

Figure 4:
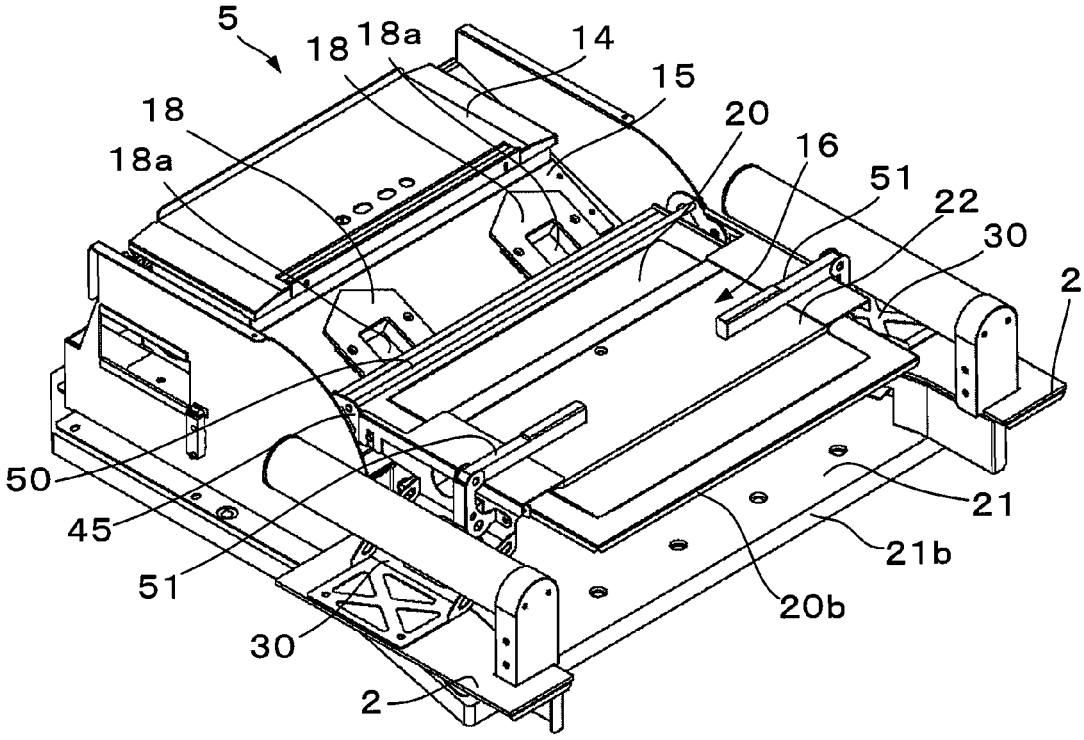
FIG. 4 is a perspective view showing a state in which the pushing member is a pushing out position.
Figure 5:
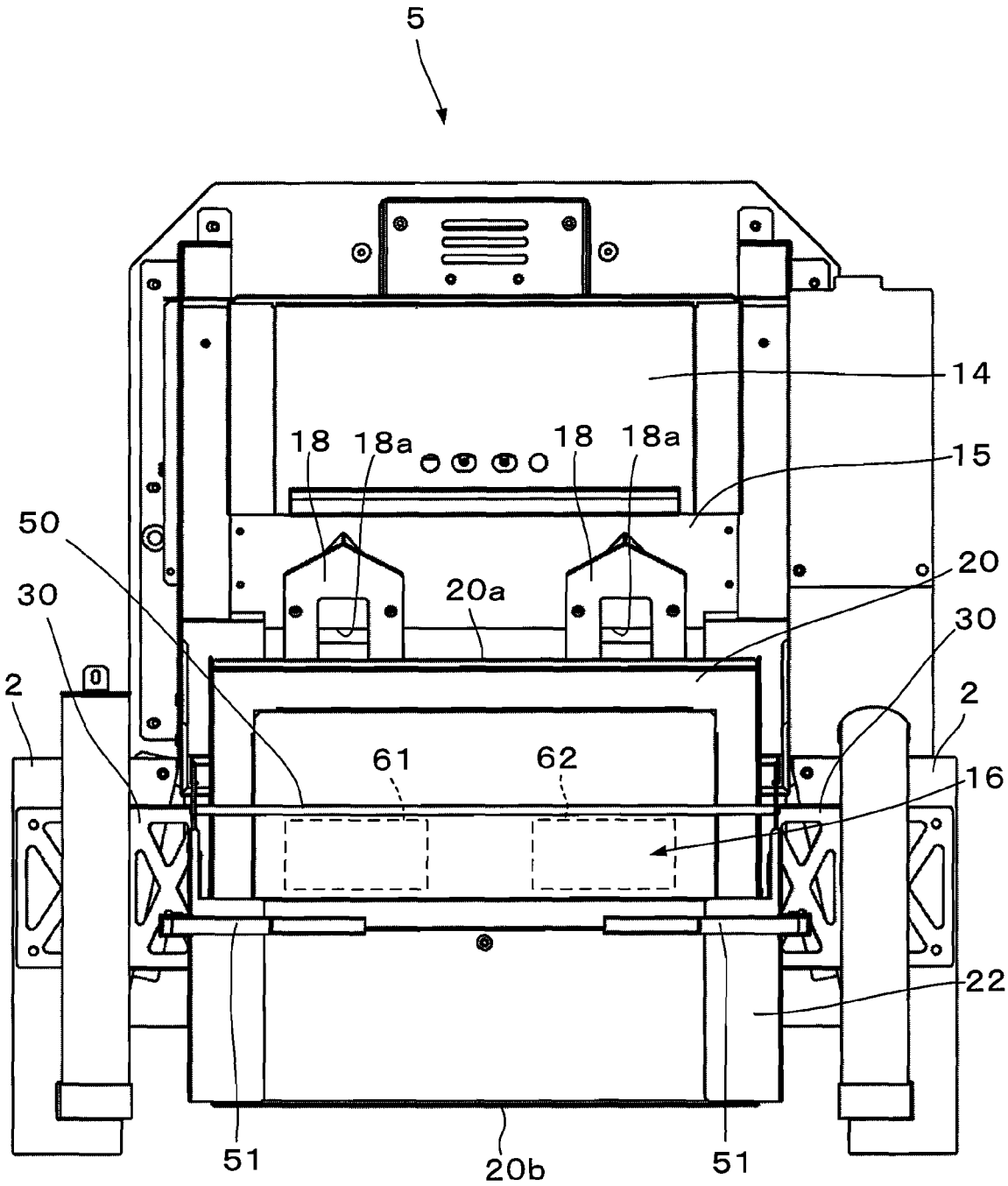
FIG. 5 is a plane view showing details of the game execution portion from the upper stage to the game board portion.

As shown in FIG. 5, a region (medal feedable region) 61 in which a medal can be fed on the upper game board 20 by the medal feeder 9 is set on the deep side of the upper pushing member 22 with regard to the medal feeding direction by the medal feeder 9. Accordingly, a player may operate the direction of the medal feeder 9 to adjust a medal feeding position in a medal feedable region 61. Moreover, the player may adjust the medal feeding timing. With regard to a set position of the medal feedable region 61, the medal feedable region 61 may also mean that the region 61 is set on the deep side of the upper pushing member 22, viewing from the side on which the medal feeder 9 feeds a medal. Here, a sign 62 in FIG. 5 means a medal feedable region of the adjacent medal feeder 9 (refer to FIG. 1). Obviously, a medal stopper 50 in the shape of a rod is provided integrally with the upper pushing member 22 on the deep side of the pushing-out surface 22*a* in the upper pushing member 22 as shown in FIG. 2 through FIG. 4, and FIG. 6, wherein the stopper 50 is extending in a state in which the stopper 50 connects between a couple of link arms 45 and 45. The medal stopper 50 is provided at a position lower than the height of a medal rolling on the upper game board 20, and the medal can not pass through the stopper 50. Accordingly, many of fed medals collide with the medal stopper 50, and fall on the upper game board 20 to block movement of the medals toward the deep side. Thereby, it is difficult to feed a medal in such a way that the medal checker 18 arranged on the further deep side of a deep edge portion 20*a* is directly aimed, wherein the portion 20*a* is located on the deep side of the upper game board 20.

When the upper pushing member 22 is located at the pushed-out position shown in FIG. 2 and FIG. 4, the medal feedable region 61 shown in FIG. 5 and the upper pushing member 22 overlap each other. Accordingly, there are some cases in which a medal is put on the upper pushing member 22, depending on the feeding timing of the medal. Thereby, there are provided wiper members 51 for each of the pair of right and left brackets 30 and 30 in such a way that the members 51 are fixed at a predetermined position to the chassis 2 wherein the member 51 sweeps out medals put on the upper pushing member 22 onto the upper game board 20 on the deep side. Instead of providing the wiper members 51, other configuration is acceptable, in which the upper surface of the upper pushing member 22 has a down grade toward the deep side so that a medal put on the upper pushing member 22 is slid down on the upper game board 20.

A medal fed on the upper game board 20 is thrust toward the deep side by the upper pushing member 22 by reciprocating movement of the upper and the lower two pushing members 22 and 23 between the retracted position to the pushed-out position to cause pileup operation between medals accumulated on the upper game board 20. According to conditions of the pileup operation, medals falls from the deep edge portion 20*a* on the upper game board 20. The medal falling from the deep edge portion 20*a* falls onto the lower game board 21, passing through a route indicated by an arrow of solid line shown in FIG. 6. Similarly, a medal (including medals which falls, passing through a route indicated by an arrow of dashed line shown in FIG. 6) which falls on the lower game board 21 is thrust toward the front side by the lower pushing member 23 to cause the pileup operation between medals accumulated on the lower game board 21. According to conditions of the pileup operation, medals falls from the front edge portion 21*b* located on the front side of the lower game board 21. The medal, which fell from the lower game board 21, is detected by a not-shown medal fall sensor, and only the detected number of medals are put out from the medal hopper device (not shown) onto the medal receiver 11 (refer to FIG. 1).

Figure 7:
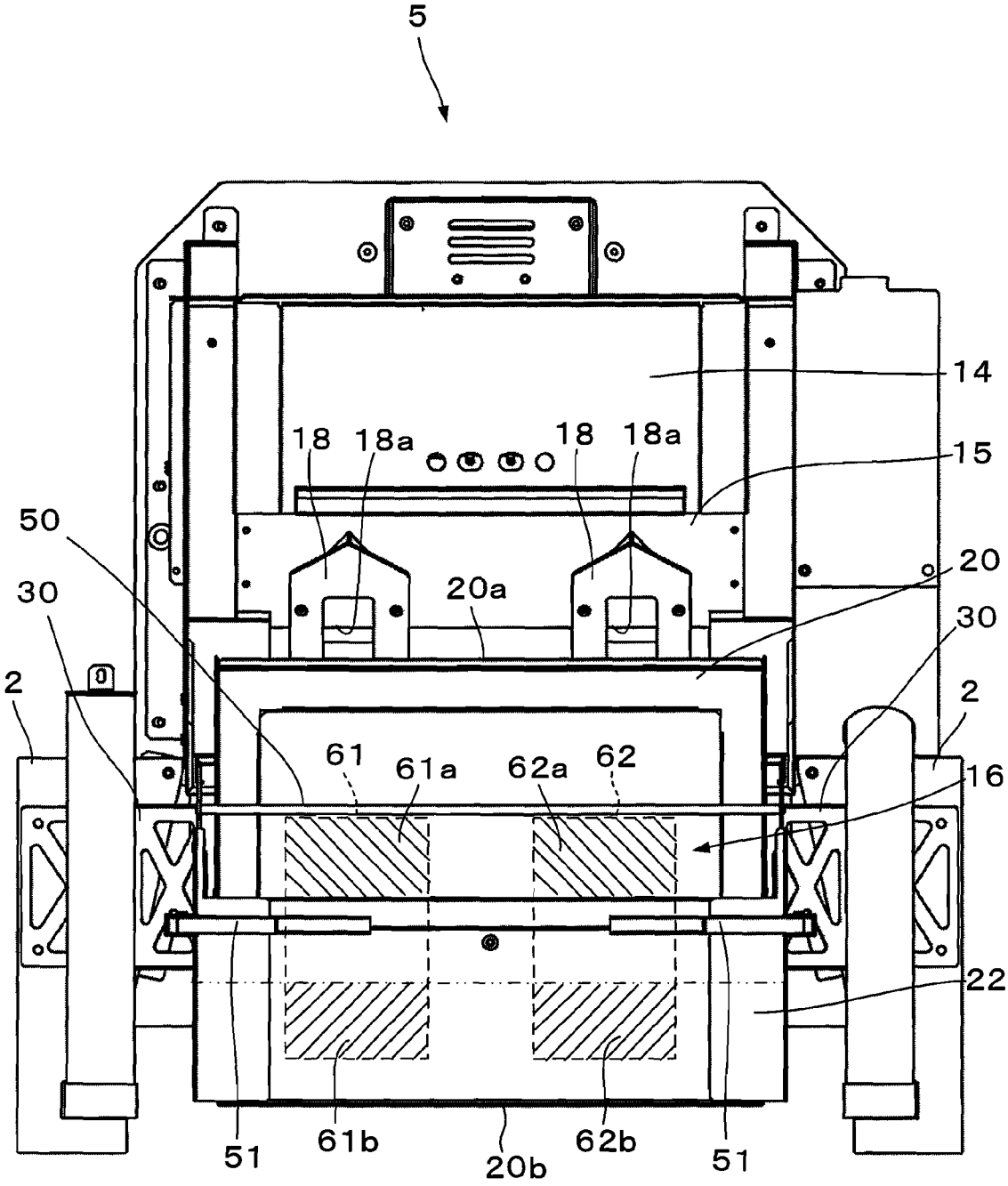
FIG. 7 is a plane view showing one form in which a medal feedable region is enlarged.

As the medal feedable region 61 and 62 are set on the deep side of the upper pushing member 22 in above-described pusher game machine 1 as shown in FIG. 5, a medal can not be fed to the front side of the upper pushing member 22. However, the medal feedable regions 61 and 62 may be enlarged as shown in FIG. 7 so that a medal can be fed to the front side of the upper pushing member 22. In order to realize the enlarged medal feedable regions 61 and 62 shown in FIG. 7, the position of the medal feeder 9 is arranged to be higher than that of the feeder 9 shown in FIG. 1, or the adjustment range of the medal feeder 9 is enlarged. By realizing a configuration shown in FIG. 7, the upper pushing member 22 may perform reciprocating movement in such a way that the medal feedable region 61 is divided into a region 61*a* on the deep side and a region 61*b* on the front side, and the medal feedable region 62 is divided into a region 62*a* on the deep side and a region 62*b* on front side. Here, an imagination line shown in FIG. 7 indicates a position of the rear end portion of the upper pushing member 22 at the pushed-out position. According to the form shown in FIG. 7, a medal may be selectively fed into either of the deep side, or the front side of the upper pushing member 22, based on the intention of the player, if a player operates the medal feeder 9, examining an operation of the upper pushing member 22, in such a way that the medal feeding timing and the medal feeding position are adjusted. Thereby, a medal may fall from the deep edge portion 20*a* located on the deep side of the upper game board 20, or from a front edge portion 20*b* located on the front side.

Figure 8:
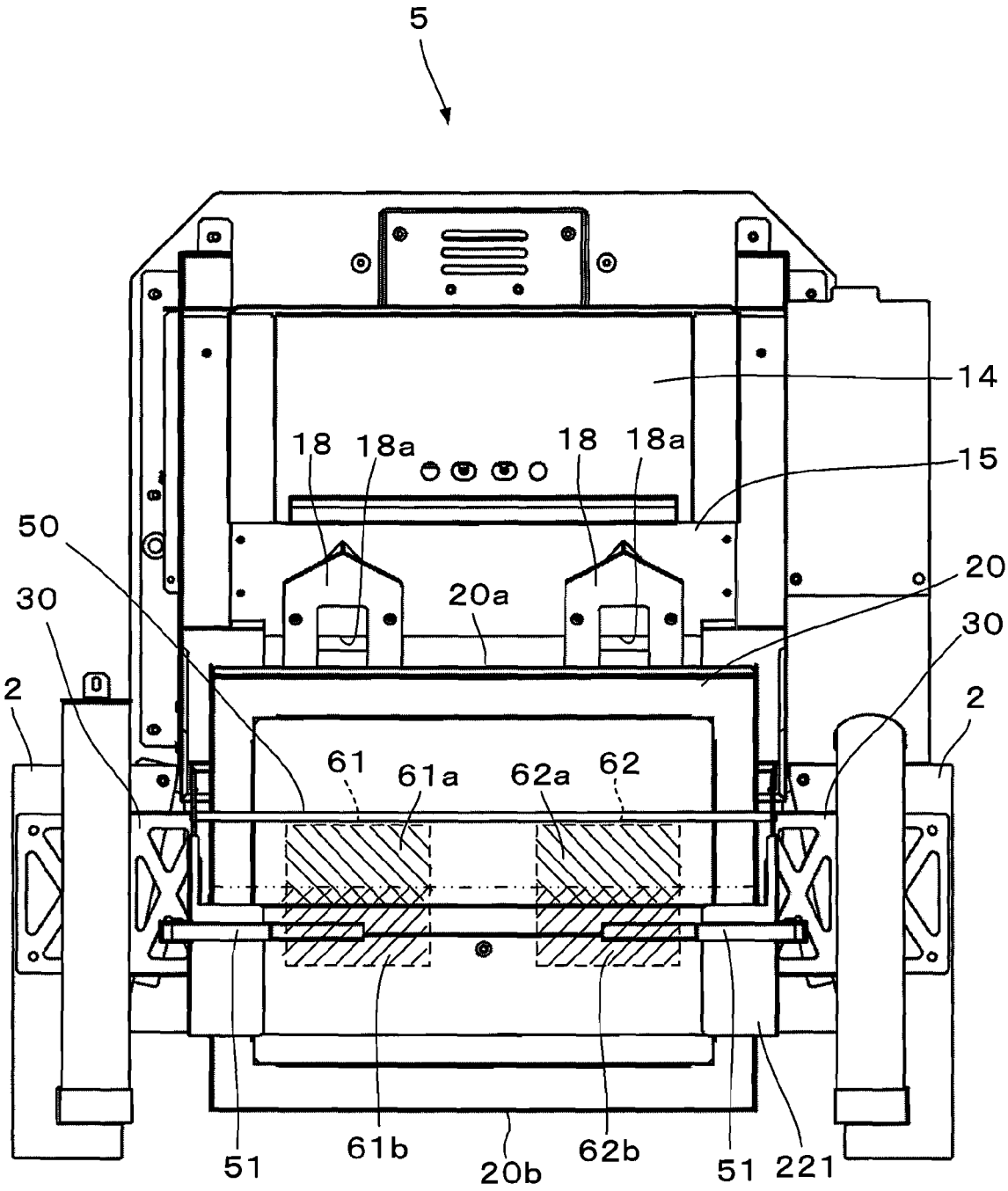
FIG. 8 is a plane view showing one form in which the medal feedable region is not enlarged in comparison with the region shown in FIG. 7, and the size of an upper pushing member in the deep direction is shortened.

Moreover, as shown in FIG. 8, each of the medal feedable regions 61 and 62 may be divided into two regions, using the upper pushing member 221 with a shortened size, while the medal feedable regions 61 and 62 are not enlarged in comparison with the case shown in FIG. 7, and the size in the deep direction of the upper pushing member 22 is shortened. In a similar manner to that of FIG. 7, the imagination line shown in the drawing indicates a position of the rear end portion of the upper pushing member 221 at the pushed-out position. The configuration as described above has advantages similar to the configuration shown in FIG. 7, and, furthermore, a medal may be accumulated on the upper game board 20 on the front side of the upper pushing member 221. In conclusion, by adequate adjustment of the size of the medal feedable region, and that of the pushing member, a medal may be selectively fed into either of the deep side, or the front side of a pushing member, based on the intention of a player.

Figure 9A:
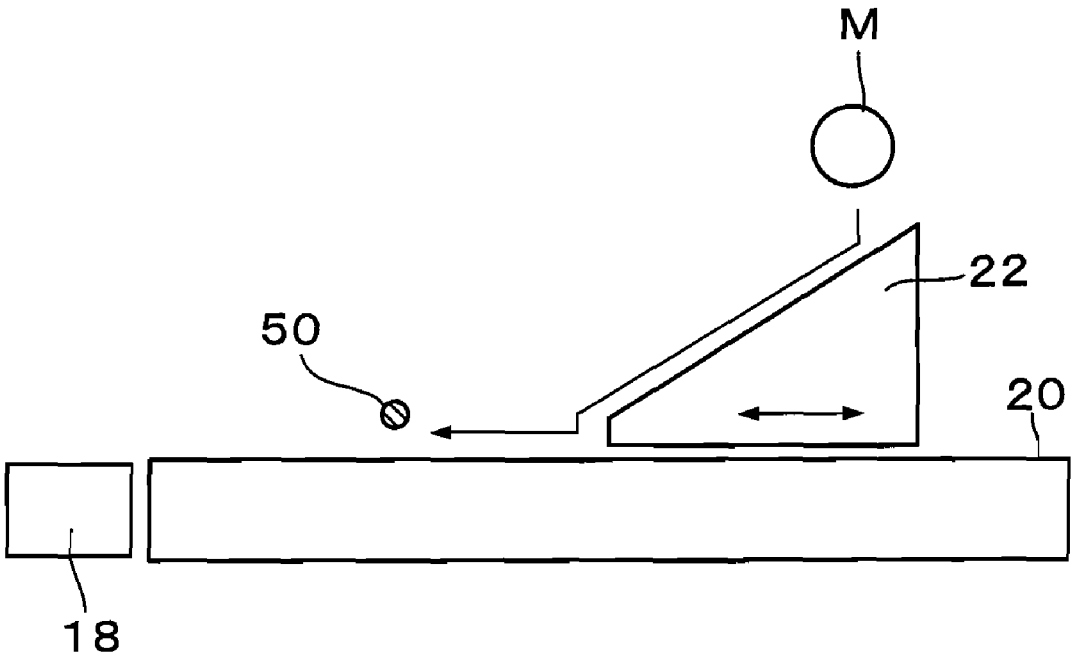
FIG. 9A is a schematic side view showing one form in which a position of a medal stopper can be changed, and the medal stopper is located at a block position.
Figure 9B:
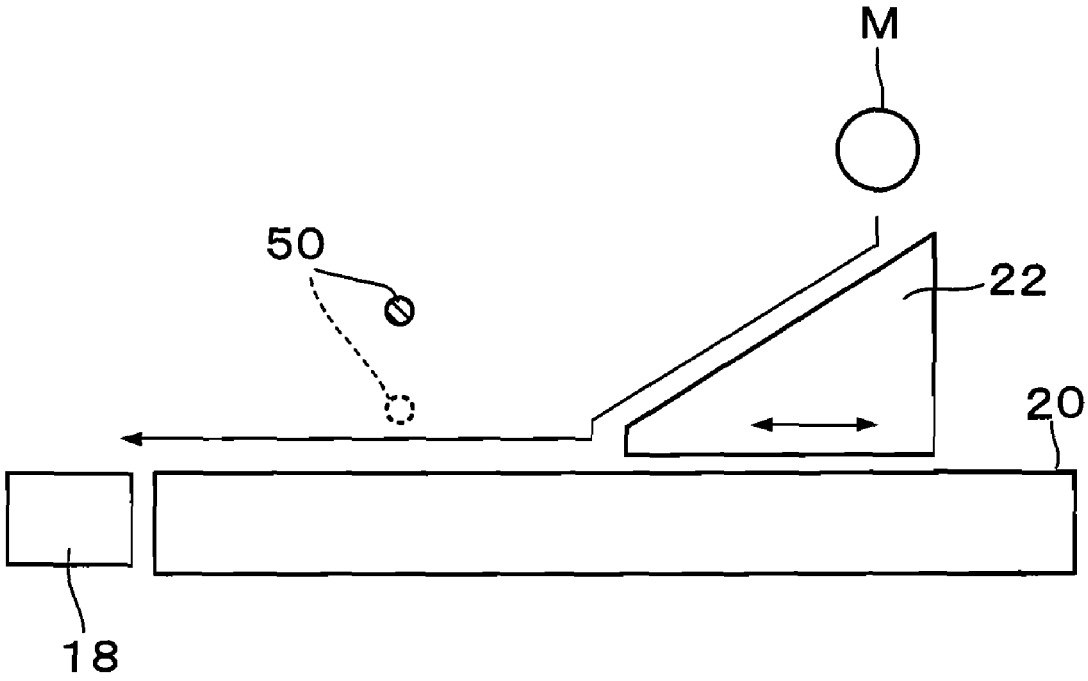
FIG. 9B is a schematic side view showing one form in which the position of the medal stopper can be changed, and the stopper is at release position.
Figure 10:
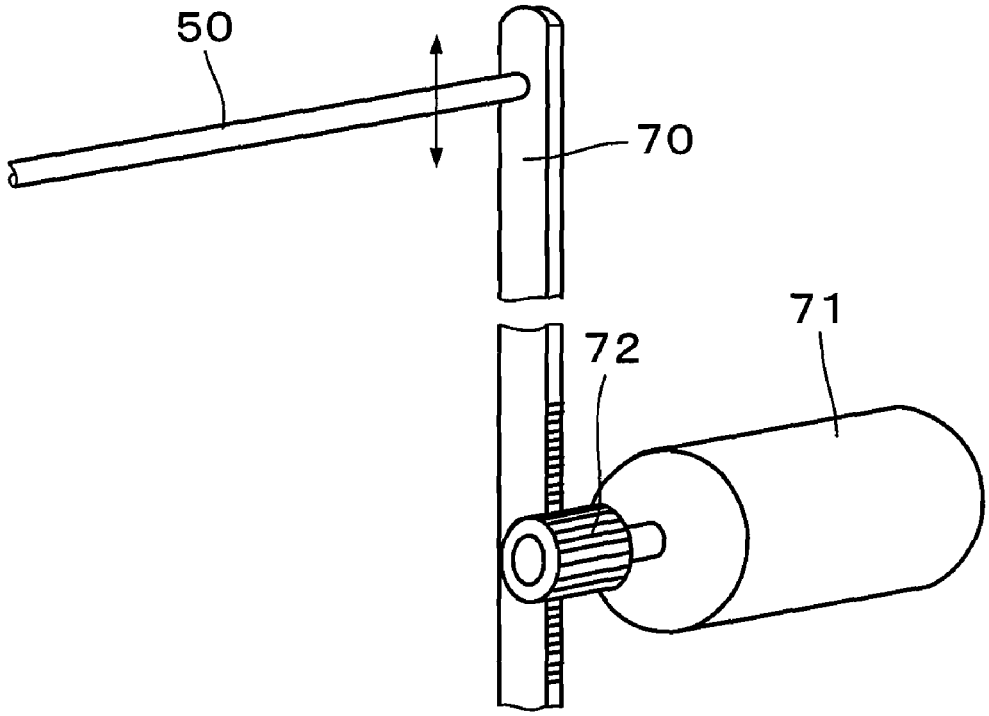
FIG. 10 is an explanatory view showing one example of a mechanism in which the position of a medal stopper can be changed.

Though the medal stopper 50 shown in FIG. 2 is fixed at a predetermined position to the chassis 2, the medal stopper 50 may be configured so that the position of the medal stopper 50 can be switched, for example, between a block position at which passing of the fed medal M is prohibited to block movement of a medal toward the deep side as shown in FIG. 9A, and a release position at which passing of the medal M is allowed, and blocking of the movement of the medal toward the deep side is released as shown in FIG. 9B. In this case, for example, when a position of the medal stopper 50 is usually set at a block position, and predetermined conditions are satisfied, a game, in which a medal checker 18 is directly aimed at, may be played by changing the position to the release position, and very exciting gaming properties may be provided, though the game is limited at the block position. A well-known mechanism may be adopted to the mechanism realizing the switching shown in FIG. 9A and FIG. 9B as needed. For example, a configuration as shown in FIG. 10 may be adapted, in which the medal stopper 50 is fitted to a rack 70, and a motor 71 is operated to drive a pinion 72 engaging the rack 70 for up and down motion of the medal stopper 50.

Figure 11:
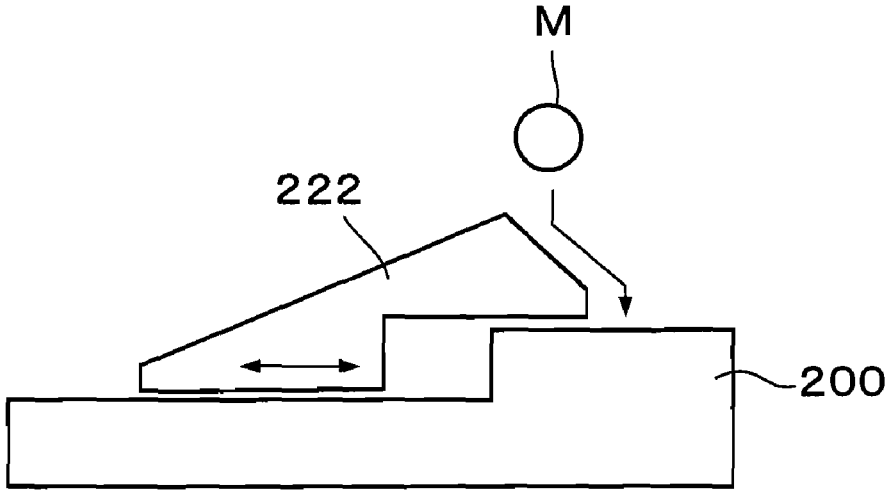
FIG. 11 is a schematic side view showing another form of an upper game board.

The upper game board 20 is not necessarily required to be a plane of a uniform height, but may be replaced with an upper game board 200 having a step-like shape, as shown in FIG. 11, with the deep side (left side in FIG. 11) lowered, and the front side (right side in FIG. 11) raised. Moreover, in accordance with this configuration, the upper pushing member 22 shown in FIG. 2 may be replaced with an upper pushing member 222 with a stepped bottom surface. Moreover, the upper surface of an upper pushing member 20 is configured to have a shape as shown in FIG. 11 having a down grade toward the deep side, and a down grade toward the front side, as shown in FIG. 11.

The medal feeding means according to the present invention is not limited to a form in which, like the medal feeder 9, a player himself or herself loads a medal to feed the medal on the game board. The medal feeding means may be configured such that a player may operate operation units such as levers, buttons, and the like for remote control to feed a medal at a desired position on the game board.

In the embodiment, the medal feeder 9 corresponds to the medal feeding means in the present invention, the upper game board 20 and 200 correspond to the game board of the present invention, the upper pushing members 22, 221, and 222 correspond to the pushing member of the present invention, the medal stopper 50 corresponds to the moving block member of the present invention, the driving motor 42 corresponds to the driving source of the present invention, a combination of the deceleration mechanism 43 and the slider crank mechanism 44 corresponds to the power transmission means of the present invention, and the link arm 45 corresponds to the connection means of the present invention, respectively. However, the present invention is not limited to the embodiment described above, and various kinds of forms may be executed within the spirit and the scope of the present invention. The present invention is not necessarily limited to a pusher game machine having the upper and the lower two step game boards, is also applicable to a pusher game machine having a single game board. Moreover, as shown in FIG. 7 or FIG. 8, the present invention may be embodied in a form in which a part of the medal feedable region is set on the deep side, and a part of the remainder is set on the front side, respectively. Moreover, in the present embodiment, the medal passing hole 18*a* by which a medal is taken in has been used as a target, and the medal checker detecting a medal passing through the medal passing hole 18*a* had been used as a medal checker detecting a medal which has hit the target, wherein the target is opposing to a part of the deep edge portion and further on the deep side of the deep edge portion of the game board located on the deep side, viewing from the feeding side. But, in the present invention, various kinds of forms, such as merely a board and merely a mark, may be adopted as the target, if a player can recognize the forms as a target. Moreover, various kinds of sensors may be used as the medal checker, for example, a contact sensor, a light shielding sensor, and an impact sensor which can detect that a medal hits the target according to a form of a target.

Though an embodiment according to the present invention has been explained as described above, the present embodiment corresponds to a further embodiment.

A conventional pusher game machine (for example, Japanese Laid-Open Patent Application No. 2001-232050), has plural steps of game boards, which have different heights in the vertical direction from each other, and, a pushing member performing reciprocating movement on each game board, wherein a medal on a game board at the upper step is pushed out by the pushing member to fall on the game board at the lower step, and, furthermore, a medal on a game board at the lower step is pushed out by the pushing member to fall on the game board at the lower step. The first invention has been made based on a conventional technology, and considering the following circumstances. That is, as the direction in which a medal is pushed out by the pushing member arranged in each of the steps is the same as each other at each of steps in a conventional pusher game machine including a plurality of steps, a game board at the lower step must protrude from a game board at the upper step in the medal pushing-out direction in order to receive a medal falling from the game board at the upper step. There is thus a possibility that the size of the device is enlarged, because increased number of steps of the game board causes the size of the device to be enlarged in the medal pushing-out direction. Moreover, as the medal pushing-out direction is the same among the game boards, there is a possibility that a player feels monotonous about the medal falling process. The first invention has an object to provide a pusher game machine in which the size of the device is prevented from being enlarged, the space efficiency is high, and an unprecedented sense about the medal falling process is given to a player.

The pusher game machine according to the first invention includes: a plurality of game boards which are different from each other in the height in the vertical direction; a medal feeding means by which a medal is fed onto at least one of the plurality of game boards; a plurality of pushing members which are provided on each of a plurality of the game boards in a state in which the pushing members can be reciprocatingly moved; and a pusher drive mechanism driving the plurality of pushing members in such a way that medals accumulated on each of the game boards are pushed out, wherein a direction, in which a medal is pushed out by an upper one of pushing members adjacent to each other, and a direction, in which a medal is pushed out by a lower one of the pushing members adjacent to each other among the plurality of pushing members, are different from each other.

According to the above pusher game machine, the size of the device is prevented from being increased in one direction in which medals are pushed out, because the medal pushing-out direction on the upper game board and the medal pushing-out direction on the lower game board are different from each other. Thereby, even when the number of game boards is increased, a reasonable layout may be realized to improve the space efficiency. As a position at which a medal falls from the upper game board, and a position at which a medal falls from the lower game board are set to be located on different sides from each other, a fresh medal falling process may be given to a player, and the enjoyment of the pusher game machine is improved.

In the pusher game machine according to the first invention, it is only required that the medal pushing-out directions are different from each other between the adjacent upper and lower game boards. For example, a medal pushing-out direction on the upper game board, and a medal pushing-out direction on the lower game board may cross each other (for example, at right angles), or a medal pushing-out direction by the upper pushing member, and a medal pushing-out direction by the lower pushing member may be parallel with each other. When the directions are set parallel with each other, the medal pushing-out direction on the upper game board and the medal pushing-out direction on the lower game board are opposite to each other. As a position at which a medal falls from the upper game board, and a position at which a medal falls from the lower game board go away from each other to increase the distance therebetween, medal falling processes becomes more dynamic.

Moreover, when the medal pushing-out directions are set parallel with each other in the upper and the lower game boards, the medal pushing-out direction on each of the game boards is set in the right and left direction with regard to the medal feeding means, or in the front and rear direction, viewing from the medal feeding side. When the pushing-out direction is in the front and rear direction, the medal pushing-out direction by the upper pushing member may be set to the deep side, viewing from the medal feeding side by the medal feeding means, and the medal pushing-out direction by the lower pushing member is to the front side, viewing from the medal feeding side by the medal feeding means. In this case, a medal falls from the deep side of the upper game board, and a medal falls from the front side of the lower game board. Thereby, a flow of medals accumulated on each of the game boards returns.

In the pusher game machine according to the first invention, there is no limitation in a configuration of the pusher drive mechanism. One drive source may be provided for each of the pushing members as one pusher drive mechanism to drive all the pushing members, or the pusher drive mechanism may include a driving source, a power transmission means by which the power of the driving source is transmitted to any one of the plurality of the pushing members, and a connection means by which the above pushing member and the other pushing member are connected. According to the above aspect, the power is transmitted through a connection means even to other pushing member by transmission of the power from one driving source to one pushing member through the power transmission means. Thereby, a driving source is not required to be provided one by one for each of the pushing members, and the configuration is simplified.

In the pusher game machine according to the first invention, it is only required that the number of the game boards is more than one. For example, two game boards may be provided as the plurality of game boards, and a medal may be fed into the upper game board between the two game boards by the medal feeding means. Moreover, for example, three or more game boards may be provided.

In the embodiments described above, the medal feeder 9 corresponds to the medal feeding means in the first invention, each of the upper game boards 20 and 200 corresponds to the upper game board in the first invention, a group of each of the upper game boards 20 and 200, and the lower game board 21 correspond to a plurality of game boards in the first invention, each of the upper pushing members 22, 221, and 222 corresponds to the upper pushing member in the first invention, the lower pushing member 24 corresponds to the lower pushing member in the first invention, a group of each of the upper pushing members 22, 221, and 222 and the lower pushing member 24 correspond to a plurality of the pushing members in the first invention, the driving motor 42 corresponds to the driving source in the first invention, a combination of the deceleration mechanism 43 and the slider crank mechanism 44 corresponds to the power transmission means in the first invention, and the link arm 45 corresponds to the connection means in the first invention, respectively.

However, the first invention is not limited to the embodiments described above, and may be realized in various forms within the gist of the first invention. It is only required that the number of the game boards is more than one, and for example, three or more game boards may be provided. Moreover, a medal pushing-out direction on the upper game board, and a medal pushing-out direction on the lower game board may cross each other (for example, at right angles). Furthermore, the layout of each of the game boards and a medal feeder may be changed so that the medal pushing-out direction on each of the game boards is in the right and left direction, viewing from the medal feeding side by the medal feeding means. Moreover, the medal pushing-out direction on the upper game board may be set on the front side, and the medal pushing-out direction of the lower game board may be set on the deep side.

Moreover, the material of the upper game board and that of the lower game board are not limited. The material of the upper game board may include a material with a transparency in such a way that the lower game board may be viewed from on high; for example, a transparent or half-transparent material such as an acrylic plate may be used. When the upper game board includes the above material, it is possible to observe the state of medals accumulated on the lower game board, or the movement of the medal while a player keeps looking the top portion of the upper game board. Thereby, the enjoyment of games may be increased, because the falling operation of medals can be easily viewed. Moreover, as the upper game board does not obstruct understanding of the game processing even when the size of the upper game board is set in such a way that the lower game board is completely covered, the size of the upper game board may be freely designed.

The second invention has been made, considering the following circumstances. That is, in a conventional pusher game machine, the medal feeding range by a medal feeder is limited to a game board extending on the medal pushing out side by a pushing member. Changing of a medal feeding position may be realized by operating a medal feeder by a player, but a selection range of a player for a medal feeding position is narrow to easily make a game monotonous. The second invention has an object to provide a pusher game machine enlarging a selection range for a medal feeding position by a player.

The pusher game machine according to the second invention includes: a medal feeding means by which a medal can be fed in a predetermined region on the game board, and at least one of a medal feeding position, or a medal feeding timing can be changed by operation of a player; and a pushing member which is arranged on the game board, and performs reciprocating movement in such a way that the predetermined region is divided into two regions.

According to the above pusher game machine, a predetermined region into which a medal can be fed by the medal feeding means is divided into two regions by the pushing member. As at least one of a medal feeding position, or a medal feeding timing can be changed by operation of a player in the medal feeding means, a player may select, based on his or her own intention, a medal feeding position, in other word, a region, in which a medal falls, from two regions divided by the medal pushing member by operating a medal feeding means. The medal feeding means that can change one of the medal feeding position and medal feeding timing is also acceptable, instead of those that can change both of the medal feeding position and the medal feeding timing. Based on the intention of a player, the player may select the medal falling region not by changing the medal feeding position, but by deciding the medal feeding timing based on linking of the medal feeding timing with the reciprocating movement of the pushing member. Thereby, a selection range of the medal feeding position for a player is enlarged. As the medal pushing-out directions by the pushing member in two regions are opposite to each other, medals may fall from the edge portion on both sides of the game board by the pileup operation of medals accumulated on the game board. Thereby, the economical values in two regions may be weighted, for example, by changing an economical value reduced to an player according to the medal falling positions. Thereby, it is possible to draw medal feeding interest for aiming a region having a relatively high economical value.

In the pusher game machine according to the second invention, there is no special limitation in a shape of the pushing member, but for example, the upper surface of the pushing member may have a down grade toward at least one region between the two regions. In this case, a medal can be led to a specific region by feeding a medal to a slope having the down grade. Furthermore, the upper surface of the pushing member may include at least two surfaces, each of which has a slope having the down grade. According to the above aspect, even without enlarging a range, in which the medal feeding position can be changed, and the stroke of the reciprocating movement of the pushing member it is easy to feed a medal to two regions by adjusting at least one of the medal feeding position, and the medal feeding timing by a player. Thereby, the size of the pushing member on the moving direction side may be reduced. Moreover, when the upper surface of the pushing member includes only the two surfaces, a medal is led to two regions only by feeding a medal toward the pushing member. Thereby, a medal is prevented from being remained on the pushing member.

In the pusher game machine according to the second invention, there is no special relation between the direction of the reciprocating movement of the pushing member and the medal feeding direction by the medal feeding means, and any positional relations for two regions are acceptable, viewing from the medal feeding side by the medal feeding means. The two regions may include the front side region in which the medal feeding means is located on the front side of the pushing member for the medal feeding direction, and the deep side region in which the medal feeding means is located on the deep side of the pushing member for medal feeding direction. According to the above aspect, a player can see falling of a medal while the player keeps looking the feeding cite of the medal when the player continues the game by feeding the medal, aiming a deep-side region, because the medal feeding direction and the medal pushing-out direction by the pushing member are the same, or are met each other at an acute angle in the deep side region. Thereby, a player may devote herself or himself to playing games because the player is not required to reciprocally look the deep side, and the front side in the medal moving direction. Moreover, gaming properties may be greatly changed, depending on regions at which a player aims because, in the deep side region, a relation between the medal moving direction after medal feeding and the medal pushing-out direction by the pushing member is in a state in which the pushing member follows the medal, and, in the front side region, the relation is in a state in which the pushing member pushes back the medal, that is, the relation is reversed between the deep side region and the front side region.

When the two regions are set as described above, there is a possibility that the fed medal easily falls from the game board regardless of the pushing member. Therefore, a moving block member which blocks moving of a fed medal may be provided on the deep side region, for example. According to the above aspect, the moving block member blocks movement of a number of medals that are fed on the game board toward the deep side. Thereby, the fed medal may be prevented from easily falling from the game board, and the put-out rate of medals and the like may be appropriately controlled.

Figure 12A:
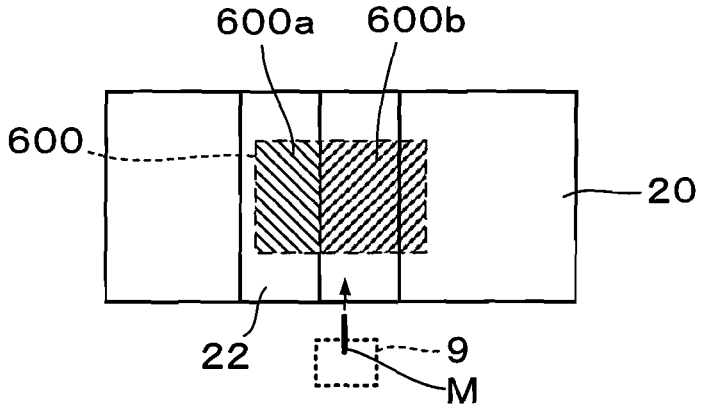
FIG. 12A is an explanatory view showing another embodiment of a layout of a medal feeder and an upper game board according to a second invention, and is a plane view showing a state in which a pushing member is at a left end position.
Figure 12B:
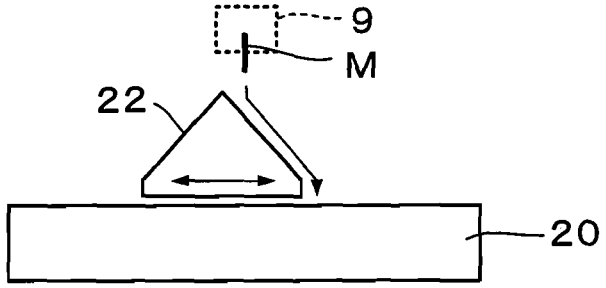
FIG. 12B is an explanatory view showing another embodiment of a layout of a medal feeder and an upper game board according to the second invention, and is a side view showing a state in which the pushing member is at the left end position.
Figure 13A:
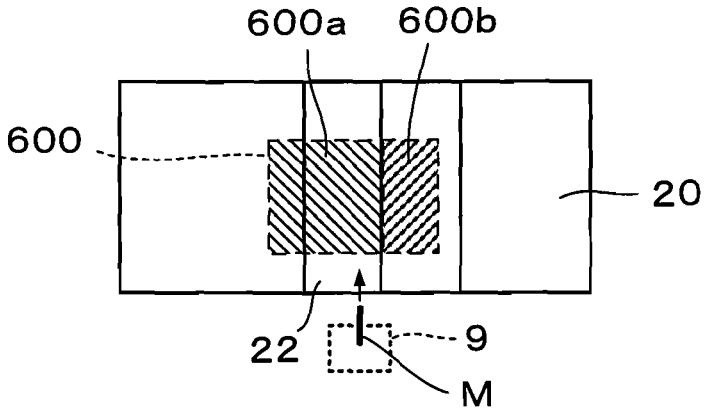
FIG. 13A is an explanatory view showing another embodiment of a layout of a medal feeder and an upper game board according to the second invention, and is a plane view showing a state in which the pushing member is at the right end position.
Figure 13B:
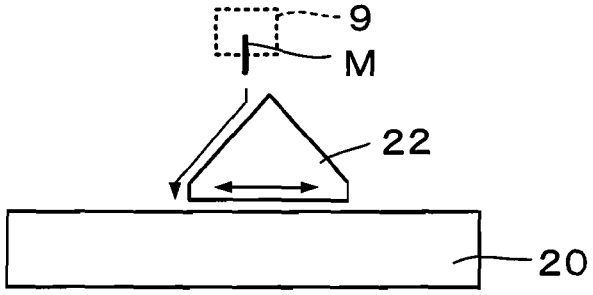
FIG. 13B is an explanatory view showing another embodiment of a layout of a medal feeder and an upper game board according to the second invention, and is a side view showing a state in which the pushing member is at the right end position.

The second invention is not limited to the above-described embodiments, and may be realized in various kinds of forms within the points of the second invention. The two regions divided by the pushing member are not required to be regions on the front side and the deep side with regard to the direction in which the medal is fed by the medal feeder. The medal feeding direction by the medal and the pushing member moving direction may be arbitrarily set. The both directions may be the same, or may intersect with each other in an oblique manner. Moreover, the directions may intersect at right angles. The layout of the medal feeder 9 and the upper game board 20 may be changed so that, as shown in, for example, FIG. 12A, FIG. 12B, FIG. 13A, and FIG. 13B, the upper pushing member 22 performs reciprocating movement between the left end position shown in FIG. 12A and FIG. 12B, and the right end position shown in FIG. 13A and FIG. 13B, viewing from the side on which the medal feeder 9 feeds the medal M. According to the above-described configuration, the medal feedable region 600 is divided into two regions of a right region 600*a* and a left region 600*b* by the pushing member 22 as shown in FIG. 12A and FIG. 13B. A player may thereby select the medal feeding position, examining the frequency of the reciprocating movement of the pushing member 22 in the right and left direction. Here, the present form may be applied to the form shown in FIG. 11.

In the above-described embodiments, the medal feeder 9 corresponds to the medal feeding means in the second invention, each of the upper game boards 20 and 200 corresponds to the game boards in the second invention, each of the upper pushing members 22, 221, and 222 corresponds to the upper pushing member in the second invention, each of medal feedable regions 61, 62, and 600 corresponds to a predetermined region in the second invention, the regions 61*a*, 61*b*, the regions 62*a*, and 62*b*, or the regions 600*a* and 600*b* correspond to two regions in the second invention, the region 61*a*, or the region 62*a* corresponds to the deep side region in the second invention, the region 61*b*, or 62*b* corresponds to the front side region in the second invention, and the medal stopper 50 corresponds to the moving block member in the second invention.

The invention claimed is:

1. A pusher game machine, comprising:

a medal feeding device which feeds a medal on a game board; and a pushing member which is arranged on the game board, and performs reciprocating movement, wherein a medal feedable region by the medal feeding device is set on a deep side of the pushing member, viewing from the medal feeding side by the medal feeding device.

2. The pusher game machine according to claim 1, further comprising a target opposing to a part of a deep edge portion, and a medal checker which can detect a medal falling from the game board and hitting the target on the deeper side of the deep edge portion, wherein the deep edge portion is located on the deep side of the game board, viewing from the feeding side.

3. The pusher game machine according to claim 2, wherein the target is a medal passing hole which takes in a medal, and the medal checker detects a medal which passes the medal passing hole as a medal having hit at the target.

4. The pusher game machine according to claim 1 further comprising a moving block member provided on the deep side of the pushing member, wherein the moving block member blocks moving of a medal toward the deep side, viewing from the feeding side.

5. The pusher game machine according to claim 4, the moving block member is provided in such a way that the block member can be moved with the pushing member integrally.

6. The pusher game machine according to claim 4, wherein the moving block member is configured in such a way that the block member can be switched at a block position at which movement of a medal toward the deep side, viewing from the feeding side, is blocked, and at a release position at which the moving blocking is released.

7. The pusher game machine according to claim 1, further comprising:

a lower game board provided at a lower height position in the vertical direction than that of the game board;

a lower pushing member provided on the lower game board in such a way that the lower pushing member can be reciprocatingly moved; and a pusher drive mechanism driving the pushing member and the lower pushing member in such a way that medals accumulated on the game board and on the lower game board are pushed out, wherein a direction in which a medal is pushed out by the pushing member, and a direction in which a medal is pushed out by the lower pushing member are set to be different from each other.

8. The pusher game machine according to claim 7, wherein a direction at which a medal is pushed out by the pushing member, and a direction at which a medal is pushed out by the lower pushing member are set to be parallel.

9. The pusher game machine according to claim 8, wherein the pusher drive mechanism comprises: a driving source; a power transmission means which transmits the power of the driving source to either of the pushing member and the lower pushing member; and a connection device connecting the above pushing member and the other pushing member.

10. The pusher game machine according to claim 1, wherein the pushing member pushes the medal away from a player.

* * * * *